US005695209A

United States Patent [19]

Deborde et al.

[11] Patent Number: 5,695,209

[45] Date of Patent: Dec. 9, 1997

[54] SKI OR OTHER SNOW BOARD, WITH CORE MADE IN SITU

[75] Inventors: Henri-Charles Deborde, Bilieu; François Jodelet, Voiron, both of France

[73] Assignee: Skis Rossignol S.A., France

[21] Appl. No.: 368,622

[22] Filed: Jan. 4, 1995

[30] Foreign Application Priority Data

Jan. 4, 1994 [FR] France ..... 94.00140

[51] Int. Cl.[6] ..... A63C 5/00

[52] U.S. Cl. ..... 280/610; 280/602

[58] Field of Search ..... 280/601, 602, 280/609, 610, 11.18

[56] References Cited

U.S. PATENT DOCUMENTS

| | | | |
|---|---|---|---|
| 2,065,179 | 12/1936 | Fosse | 280/610 |
| 2,228,202 | 8/1941 | Davidson | 280/610 |
| 2,526,137 | 10/1950 | Hunt . | |
| 2,581,532 | 1/1952 | Hem | 280/610 |
| 3,635,483 | 1/1972 | Barriball et al. | 280/610 |
| 3,636,482 | 1/1972 | Holman | 280/610 |
| 3,901,522 | 8/1975 | Boehm | 280/610 |
| 4,071,264 | 1/1978 | Legrand et al. | 280/610 |
| 4,902,548 | 2/1990 | Cholat-Serpound et al. | 280/610 |
| 5,002,300 | 3/1991 | Pascal et al. | 280/602 |
| 5,186,777 | 2/1993 | Perenon et al. | 280/610 |
| 5,197,752 | 3/1993 | Engelbert et al. | 280/610 |
| 5,242,187 | 9/1993 | Diard et al. | 280/601 |
| 5,286,051 | 2/1994 | Scherubl | 280/610 |
| 5,618,054 | 4/1997 | Fagot | 280/610 |

FOREIGN PATENT DOCUMENTS

| | | | |
|---|---|---|---|
| 1241437 | 8/1960 | France | 280/610 |
| 1435153 | 3/1966 | France | 280/610 |
| 2048079 | 3/1971 | France | 280/610 |
| 2185421 | 1/1974 | France . | |
| 2505193 | 11/1982 | France | 280/610 |
| 2605234 | 4/1988 | France . | |
| 2476495 | 8/1991 | France | 280/610 |
| 2114502 | 10/1972 | Germany | 280/610 |
| 459843 | 9/1968 | Switzerland | 280/610 |
| WO 86/02279 | 4/1986 | WIPO | 280/610 |

*Primary Examiner*—Brian L. Johnson
*Assistant Examiner*—Min Yu
*Attorney, Agent, or Firm*—Parkhurst, Wendel & Burr, LLP

[57] ABSTRACT

A ski or other snow board, has an injected core extending at least up to the tip. Along a neutral fiber there is placed either a metal plate which is coated with rubber on its two faces, or a simple band of rubber or visco-elastic material. Resilience to shear forces is thus obtained, and the risk of breaking the tip is thereby reduced. The same structure may also be provided at the heel of the ski.

14 Claims, 5 Drawing Sheets

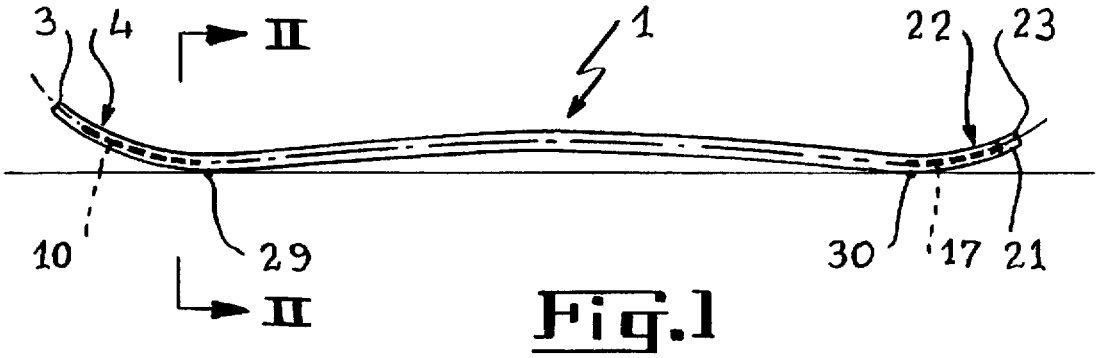
Fig.1
Fig.2
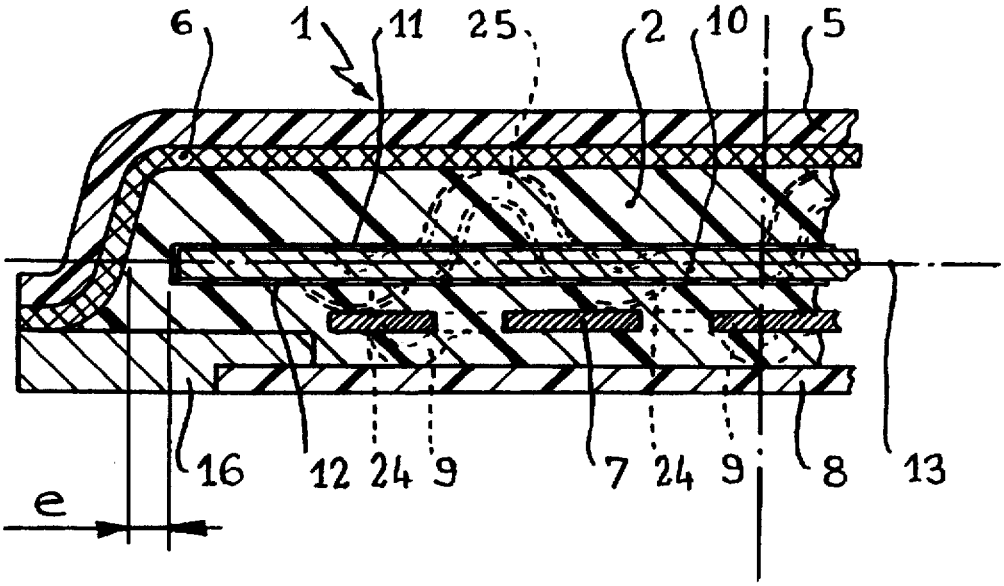

SKI OR OTHER SNOW BOARD, WITH CORE MADE IN SITU

FIELD OF THE INVENTION

The present invention relates to a ski, or other snow board, having a core made in situ either by casting a non-cellular thermoplastic or thermosettable product, or by injecting components of a foam of a synthetic product.

BACKGROUND OF THE INVENTION

It is known to manufacture a core of a ski by casting in situ, i.e. directly in the mold, a non-cellular thermoplastic or thermosettable product, being mono-constituent or multiconstituent, which polymerizes under the effect of temperature.

Similarly, it is known to inject into the mold the components of a foam of a synthetic product adapted form, after hardening, the core of the ski. The noted synthetic product is usually a polyurethane foam.

In fact, the foam components are injected into the mold at the level of the tip or of the tail, and these components then on reacting with one another, form the foam inside the mold.

This technique is illustrated An documents FR-A-2 366 034, FR-A-2 549 378, FR-A-2 700 479 and FR-A-2 705 247.

The synthetic foam fills the internal cavity of the ski to forms core. The rear end of the ski is closed by a so-called "heel piece", and the internal cavity extends between the heel piece and the front end of the tip. The front end can be either truncated, in which case a tip element can be added, or not truncated, such that the tip constitutes the front end of the ski.

The core of the ski therefore extends over substantially the entire length of the ski, except for the heel piece and possibly added tip endpiece. This aforementioned ski construction differs from the majority of more traditional skis having non-injected sandwich-type structures in which the core is machined before the ski molding operation, and in which the core stops at the ski molding operation, and in which the core stops at the level of front and rear lines of contact of the ski, i.e. respectively at the point of origin of the tip and of the heel.

In a ski where the core is made in situ, the tip and the heel are relatively thin zones, and accordingly, the portion of core which occupies the inner part of the tip and of the heel is of relatively small thickness. As a result, the core is, in the tip and in the heel, virtually constituted by the superposition of the two upper and lower "layers of skin" of the core.

It is noted that any piece made of rigid plastic foam obtained by an injection process is, after setting, surrounded on all sides by a thin layer of greater density than a portion located inside the piece. This so-called "skin layer" is more brittle, and is normally eliminated by machining in the case of cores intended for the traditional manufacture of skis by the "sandwich" process. However, the skin layer necessarily remains inside the ski in the case of a ski manufactured by the process of in situ injection.

As a result, the tip and the heel of injected skis are particularly brittle elements, representing a drawback in particular for the tip which is an element whose overhang is quite considerable.

It often happens, particularly in ski-lift queues, that a skier accidentally walks on the tip of another skier's ski. In the case of injected skis, the tip may, therefore, easily break.

Furthermore, when skiing, the tip oscillates considerably, like a pendulum, due to its considerable overhand: This motion is called "whipping". With injected skis, the core extends to the end of the tip, thereby resulting in considerable deformations. Moreover, as the skis are used under extreme conditions of cold and humidity, the risk of breakage increases.

The core of a ski under bending stress under the effect of a load generates compression stresses on its upper part and tensile stresses on its lower part. A so-called neutral-fiber median surface represents the zone where the stresses are zero but where shear is maximum.

Those parts of the high-density core which occupy the interior of the two end elements, tip and heel, present, due to their high density, a relatively low resistance to the shear effects, which may provoke delaminations which may damage the interior of the ski structure.

It is an object of the present invention to overcome these drawbacks.

SUMMARY OF THE INVENTION

The present invention relates to a ski or other snow board, comprising an outer envelope which comprises at least one lower sole for sliding and a top made of plastic material. The central core of the ski is produced by filling in situ with a material, expansible or not, and extending from the rear end, or heel, of the ski to the front end, or tip, of the ski, not including an added heel piece and possible tip piece. There provided, inside the structure which defines the tip and/or the heel, and in the proximity of a neutral fiber of the ski, at least one longitudinal band of material having elastic properties. Means is provided to maintain, during the core injection operation the elastic band substantially at the level of the neutral fiber.

This elastic band is preferably borne by a semi-rigid plate such as a metal plate, the latter preferably being coated with an elastic band on its two faces.

The material is preferably a visco-elastic material, which, by the shear effects enables it to dampen vibrations due to the pendulum motion of the tip.

BRIEF DESCRIPTION OF THE DRAWINGS

The invention will be more readily understood on reading the following description with reference to the accompanying drawings, in which:

FIG. 1 is a side view of a ski according to the invention, with injected core.

FIG. 2 is a transverse half-section of the ski along II–III of FIG. 1.

DESCRIPTION OF PREFERRED EMBODIMENT

Figure 3:
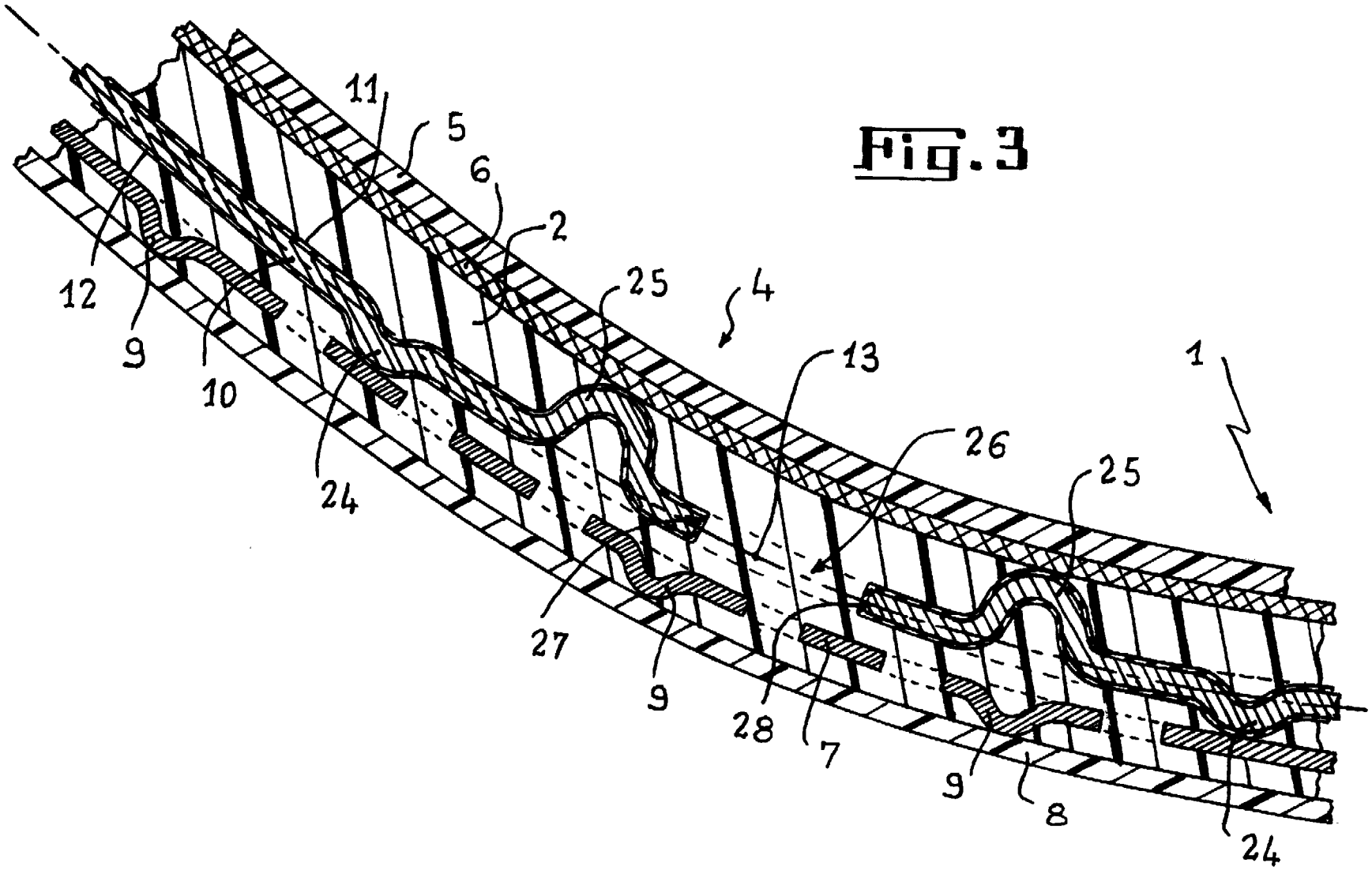
FIG. 3 is an enlarged view, in longitudinal section, of a portion of the tip of the ski.

Referring now to the drawings, FIGS. 1 to 4 show a ski 1 of the so-called "injected shell" type and therefore presenting a core 2 of injected polyurethane foam which extends from the front end 3 of the tip 4 up to the rear end 21 of the heel 22, not including added heel piece 23. The top and the edges of the ski are formed by a shell 5 made from a sheet of plastic material.

It should be noted that the added heel piece 23 is an element independent of the core of the ski 1 and positioned to the rear thereof. In fact, it can be added after demolding, or may be positioned in the mold before the injection operation. The core therefore stops at the transverse line 21 as mentioned hereinabove.

The front end of the tip is understood here to mean the end of the tip 4 which forms an integral part of the body and therefore of the core of the ski 1. Obviously it does not include a possible tip piece (absent in these drawings) which is sometimes added on the end of the tip 4, which end is, in that case, typically truncated.

FIG. 1 indicates, on the one hand, the front line of contact 29 and, on the other hand, the rear line of contact 30 which respectively characterize, as is known, the point of origin to the tip and of the heel or, in other words, the beginning of the "raised tip" and the beginning of the "raided heel".

An upper reinforcement 6 formed by a textile lap conventionally adheres beneath the upper face of the shell 5, while a lower metal reinforcement 7 constituted by a perforated metal band is placed on the sole 8. The sole 8 is bordered by edges 16. This metal reinforcement 7 is embedded in polyurethane and, to that end, presents a certain number of stamped portions 9 which maintain it, before the injection operation, at a sufficient distance from the sole 8.

According to the invention and in order to provide the tip 4 with improved bending strength and therefore also improved shear resistance, a metal plate 10, for example of aluminum alloy, totally embedded in the polyurethane and coated with a band of elastic layer 11, 12 on each of its two (upper and lower) faces, is positioned in the structure of the tip 4 along a neutral fiber 13 of the ski.

The elastic layers 11 and 12 are made of any elastic material, for example rubber or elastomer. However, layers 11, 12 are preferably made of visco-elastic material, which gives the tip 4 of the ski additional properties of damping vibratory waves which tend to be generated during the pendulum-like oscillations of the tip 4 when skiing.

Figure 4:
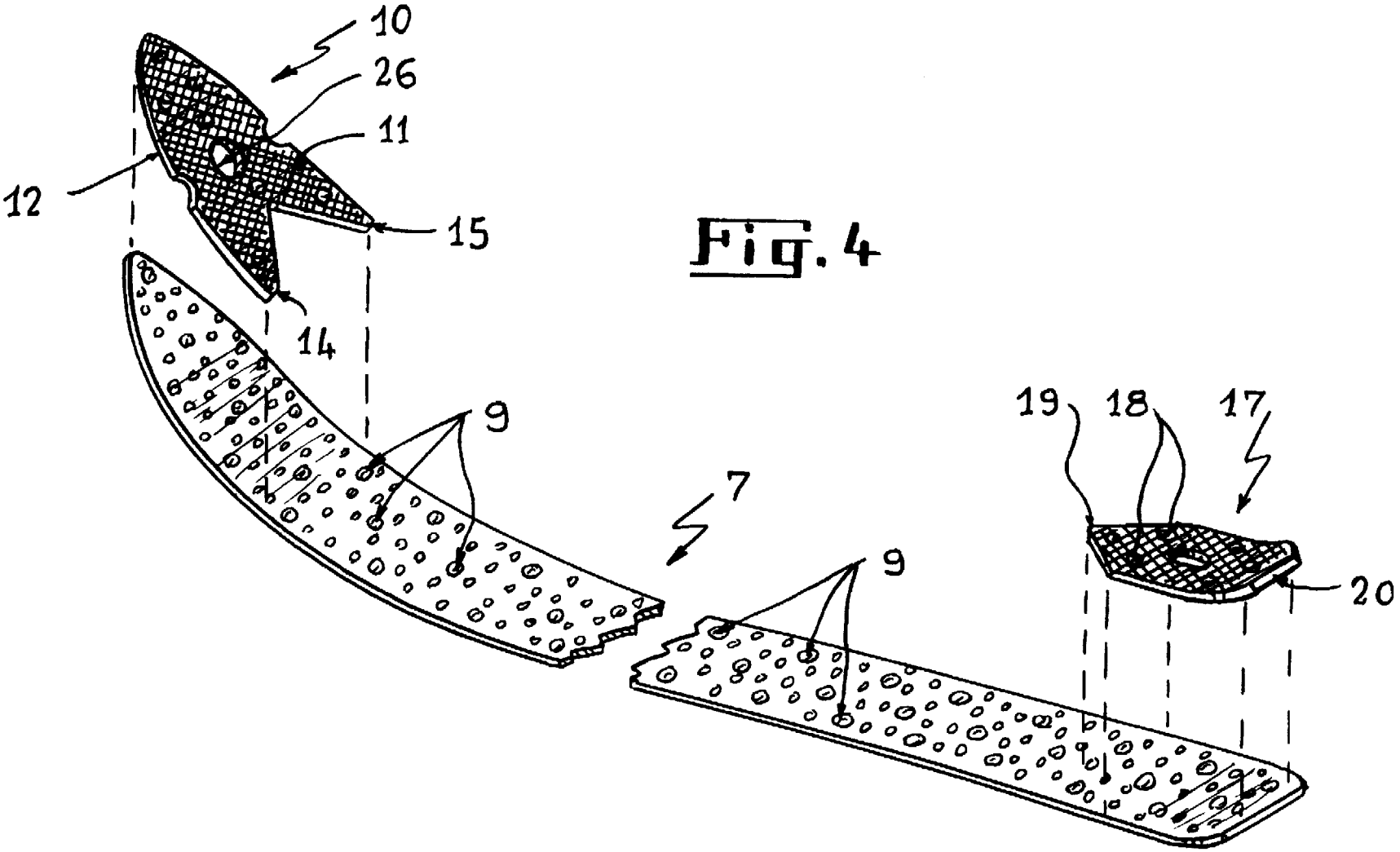
FIG. 4 is an exploded view, in perspective, of the conventional lower metal reinforcement of the ski, the reinforcement being surmounted, at the tip and at the heel, with a double rubber-coated metal plate, according to the invention.

The plate 10 is arcuate in order to follow the camber of the tip. At the front, it follows the pointed form of the latter and, at the rear, it does not join the inner structure of the ski, constituted essentially by the core 2, suddenly, but rather progressively in two pointed fins 14, 15, as shown in FIG. 4.

The plate 10 is maintained in position, in the injection mold, by lower stamped portions or bosses 24 via which it rests on the reinforcing plate 7 and is maintained at a distance therefrom to allow easy passage of the injection foam, and, by upper bosses 25 via which it is pressed against the upper reinforcement 6 and maintained at a distance therefrom.

In order to facilitate passage of the injection foam on either side of the plate 10, the latter is pierced with at least one sizeable slot or orifice 26 whose edges 27 are themselves coated with a layer 28 of visco-elastic material.

All three layers 10, 11, 28 preferably have the same visco-elastic material deposited thereon, in the same vulcanization operation, and are of the same thickness.

Layer 28 enables the plate 10 to work in shear without being prevented from so doing by the material the core 2 traversing the orifice 26.

It is important that the plate 10 work in shear on virtually the whole width of the core 2 and as clearly shown in FIG. 2, it consequently extends over virtually the whole width of the core 2, leaving, on either side respectively, only a width "e" of core material 2 which is not greater than about 2 mm.

Preferably, the injected ski of the present invention is also provided at the heel 22 with another double rubber-coated metal plate 17 which, like plate 10, is positioned at the level of neutral fiber 13 and which is provided with bosses 18 for maintaining a particular position.

Like plate 10, the plate 17 does not join the inner structure 2 of the ski, in the longitudinal direction, suddenly, but rather progressively. To that end, and by way of non-limiting example, the front edge 19 of the plate 17 is pointed, while its rear edge 20 follows the shape of the heel piece of the ski.

The length of these plates 10, 17 corresponds approximately to the overhang lengths of the tip end of the heel, respectively, between 220 and 300 mm for the tip and between 30 and 80 mm for the heel.

The thicknesses of the elastic layers 11 and 12 may vary from 0.05 to 2 mm.

It goes without saying that the invention is not limited to the embodiment which has just been described. Plates 10, 17 may be coated with elastic product only on one face. In that case, the elastic layer must lie in the immediate vicinity of the neutral fiber 13.

The elastic layer or layers 11, 12 may each be composed of a plurality of superposed elastic layers having different characteristics, and possibly different thicknesses. They may be deposited by adhesion rather than vulcanization. Instead of being made of metal, plates 10, 17 may also be of any other semi-rigid material, for example, "ABS" or other similar plastic material.

Figure 5:
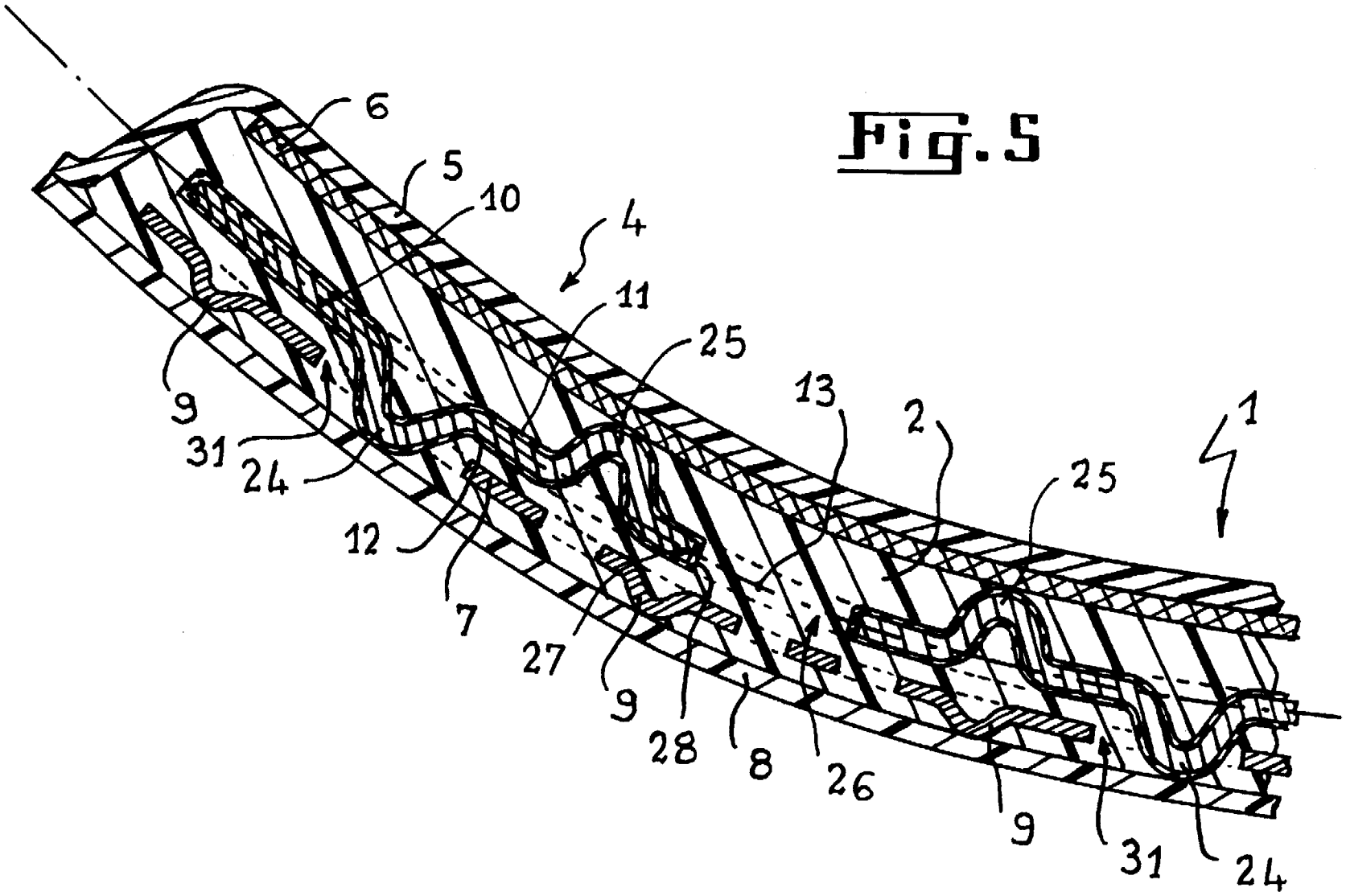
FIGS. 5 and 6 are views similar to FIG. 3, illustrating two variant embodiments of the ski according to the present invention.

With reference to FIG. 5, means are provided such that double rubber-coated metal plate 10 no longer rests on the metal reinforcement 7, but instead on the sole 8. To obtain this result, recesses 31 are provided in lower metal reinforcement 7 to allow passage of the lower bosses 24 such that the lower bosses 24 rest on the sole 8 end not on metal reinforcement 7.

Figure 6:
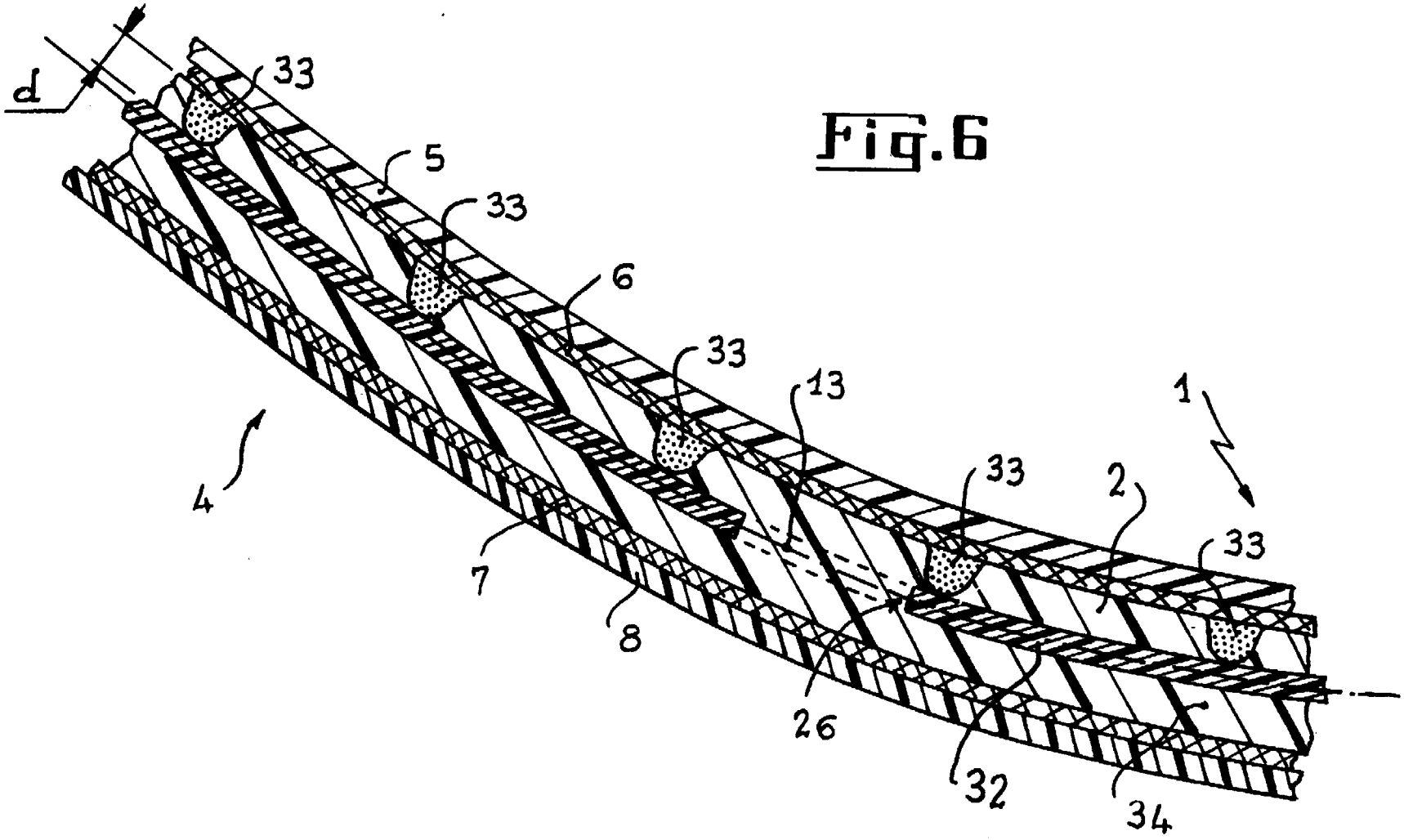

The presence of a support plate 10, 17 is advantageous as it increases the solidity at the heel 22 and the tip 4, but it is in no way compulsory and it may simply be provided, at the tip and/or heel, to position, in accordance with FIG. 6, a band 32 of elastic material, having the same shape for example as plates 10 and 17 and itself provided with orifice 26, along the neutral fiber 13. This elastic band may be positioned for example as illustrated in FIG. 6, by means of bracing studs or beads 33, made of, for example, "hot-melt" type glue which is widely available on the market.

Before the mold-injection operation, the ski includes two sub-assemblies:

(1) a lower assembly comprising the sole 8 and the lower reinforcement 7 which, in this example, is a conventional reinforcement of pre-glued glass fabric, and (2) an upper assembly comprising the top or shell 5, lined with the reinforcement 6 of pre-glued glass fabric, on which the band 32 of visco-elastic material is positioned, at a determined distance d such that it is positioned along the neutral fiber 13 and corresponding to the height of bracing studs or beads 33 positioned regularly to that end.

These two sub-assemblies are then positioned on one another in the mold, the latter being conventionally provided with shoulders allowing a spacing 34 to be maintained between the two sub-assemblies, this spacing 34 being determined for the band 32 to be well positioned along the neutral fiber 13.

In the embodiment of FIG. 1, the front plate 10 extends substantially (forwardly) from the front line contact 29 to the ski 1, while the rear plate 17 extends substantially (rearwardly) from the rear line of contact 30 of the ski. This is not limiting and, by way of numerical example, according to one embodiment of the invention, plate 10 extends 5 cm in front of the front line of contact 29.

What is claimed is:

1. A ski, comprising:

an outer envelope comprising a lower sole for sliding and a top made of plastic material extending between, and including, a heel structure and a tip structure of said ski;

a central core, filling a void defined by said lower sole, top, heel structure and tip structure, produced by in situ injection of one of expansible and nonexpansible materials, said central core in said heel and tip structures including only two superposed layers of skin of said one of expansible and nonexpansible materials;

a longitudinal band constituted of one of rubber, elastomer and visco-elastic material, located in a position in proximity to a neutral fiber of said ski and disposed within said injected core between said layers of skin within at least one of said heel structure and tip structure, said longitudinal band dividing said core into upper and lower regions; and means for maintaining said longitudinal band at said position in proximity to a neutral fiber during said in situ injection to produce said core.

2. The ski of claim 1, wherein said longitudinal band is supported by a semi-rigid plate.

3. The ski of claim 2, wherein said longitudinal band joins the internal structure of said ski progressively.

4. The ski of claim 2, wherein said plate is pierced with at least one orifice adapted to allow injection material to flow therethrough and a surface of said orifice is coated with a layer of one of elastic and visco-elastic material.

5. The ski of claim 4, wherein said one of elastic and visco-elastic material is deposited on said plate and on the surface of said orifice by vulcanization.

6. The ski of claim 2, wherein said plate is provided with one of bosses and stamped portions to maintain said plate at a predetermined position relative to said neutral fiber.

7. The ski of claim 6 wherein a lower reinforcement, located in the void defined by said lower sole, top, heel structure and tip structure and maintained at a predetermined distance from said sole, has recesses to allow said one of bosses and stamped portions of said plate to pass therethrough and rest on said sole.

8. The ski of claim 2, wherein said plate is a metal plate.

9. The ski of claim 1, wherein said longitudinal band is pierced with at least one orifice adapted to allow injection material to flow therethrough.

10. The ski of claim 1 wherein said longitudinal band is maintained, before said in situ injection, substantially along said neutral fiber by one of bracing studs and beads.

11. The ski of claim 10, wherein said one of bracing studs and beads is formed by glue.

12. The ski of claim 1, wherein said elastic longitudinal band extends laterally over substantially the entire width of said core.

13. The ski of claim 12, wherein said longitudinal band leaves, on either side thereof, a space of less than about 2 mm with respect to an inner wall of said outer envelope of said ski wherein core material is present.

14. The ski of claim 2, wherein said plate has two opposed faces covered by said longitudinal band.

* * * * *